US006187489B1

(12) United States Patent
Oishi et al.

(10) Patent No.: US 6,187,489 B1
(45) Date of Patent: Feb. 13, 2001

(54) ELECTROSTATIC LATENT IMAGE DEVELOPING TONER AND IMAGE-FORMING PROCESS

(75) Inventors: Kaori Oishi; Susumu Yoshino; Yasuhiro Oya; Hirokazu Hamano; Masanobu Ninomiya; Tetsuya Taguchi; Koutarou Yoshihara, all of Minamiashigara (JP)

(73) Assignee: Fuji Xerox Co., LTD, Tokyo (JP)

( * ) Notice: Under 35 U.S.C. 154(b), the term of this patent shall be extended for 0 days.

(21) Appl. No.: 09/514,635

(22) Filed: Feb. 29, 2000

(30) Foreign Application Priority Data

Mar. 16, 1999 (JP) ..... 11-070596

(51) Int. Cl.[7] ..... G03G 13/01; G03G 9/097
(52) U.S. Cl. ..... 430/45; 430/111; 430/126
(58) Field of Search ..... 430/45, 111, 137, 430/126

(56) References Cited

U.S. PATENT DOCUMENTS 6,042,979 * 3/2000 Ohishi et al. ..... 430/45
6,077,635 * 6/2000 Okado et al. ..... 430/45

FOREIGN PATENT DOCUMENTS 52-3304 1/1977 (JP) .
60-136755 7/1985 (JP) .
1-133065 5/1989 (JP) .
2-100059 4/1990 (JP) .
2-161466 6/1990 (JP) .
3-122660 5/1991 (JP) .
3-229265 10/1991 (JP) .
3-260659 11/1991 (JP) .
5-072797 3/1993 (JP) .
5-188633 7/1993 (JP) .
5-204183 8/1993 (JP) .
6-051561 2/1994 (JP) .
6-095429 4/1994 (JP) .
6-102699 4/1994 (JP) .
6-208242 7/1994 (JP) .
6-250442 9/1994 (JP) .
6-266156 9/1994 (JP) .

OTHER PUBLICATIONS

"Surface Treatment of Ultrafine TiO2 Particles by Vapor–Phase Hydrolysis", S.Okanishi et al., Journal of Chemical Engineerings, vol. 18, No. 3, 1992, pp. 303–307.

* cited by examiner

*Primary Examiner*—John Goodrow
(74) *Attorney, Agent, or Firm*—Oliff & Berridge, PLC

(57) ABSTRACT

A full-color latent image developing toner composed of toner particles containing a binder resin, a coloring agent, and a surface lubricant, and at least one kind of an external additive, wherein the toner contains at least about 3% the surface lubricant, the toner includes irregular-shaped particles of $ML^2/A \geqq 125$, and when the emission voltage caused by the carbon originated in the binder resin of the toner particles is X and the emission voltage caused by the element originated in the external additive is Y, and when the relationship between $X^{(2/3)}$ and Y are primary-regressed to the straight line passing through origin of a coordinate, the correlation factor of the element originated in at least one external additive is not less than 0.4. As the external additive, a titanium compound obtained by reacting $TiO(OH)_2$ prepared by a wet method and a silane compound is preferably used.

15 Claims, 1 Drawing Sheet

ELECTROSTATIC LATENT IMAGE DEVELOPING TONER AND IMAGE-FORMING PROCESS

FIELD OF THE INVENTION

The present invention relates to an electrostatic latent image developing toner for full color image formation suitable for an electrostatically charged image (hereinafter, referred to as electrostatic-charged image) developer used for developing electrostatic latent images in an electrophotographic process, electrostatic recording process, etc., and also to an image-forming process using the toner.

BACKGROUND OF THE INVENTION

In an electrophotographic process, an electrostatic latent image formed on a photoreceptor is developed with a toner containing a colorant, and the toner image formed is transferred onto a transfer paper and fixed by a heat roll, etc., to obtain an image. The photoreceptor after using is subjected to cleaning for forming an electrostatic latent image again. A dry type developer used for such an electrophotographic process, etc., is generally classified into a one-component developer using a toner itself formed by dispersing a colorant in a binder resin and a two-component developer made of a mixture of the toner and a carrier. Also, in the case of carrying out the image formation using such a developer, in order that the developer has a process adaptability, it is necessary that the developer is excellent in the fluidity, conveying property, fixing property, charging property, transferring property, and cleaning property. Also, recently, the requirement of color-image formation, and particularly, on-demand printing is high, and to cope with high-speed many-copy copying, a heat roller system has been widely used for a fixing step because a high-speed fixing is possible.

As a problem in the fixing system, because a toner image in a molten state is brought into contact with the surface of a heat roller under pressure, a part of the toner image sticks to the heat roller, the stuck toner is transferred to sometimes cause a so-called offset phenomenon of staining the copied images. For the purpose of preventing the occurrence of the phenomenon, a method of coating the surface of the heat roller with a silicone rubber or a fluorine resin excellent in a releasing property and further supplying a liquid having a releasing property, such as a silicone oil, etc., to the surface thereof has been employed. The method is very effective in the point of preventing the occurrence of the offset phenomenon of a toner but in the method, there is a problem that an apparatus for supplying an offset-preventing liquid becomes necessary. This is contrary to small-sizing and light-weighing of the copying machine, and also there occurs a problem that the offset-preventing liquid is evaporated by heating to give an unpleasant smell and sometimes stain the inside of the copying machine.

To solve these problems, a method of limiting the viscosity of the toner (Japanese Patent Laid-Open Nos. H1-133065, H2-161466, H2-100059, and H3-229265), a method of incorporating a wax such as a resin having a releasing property in a toner (Japanese Patent Publication No. S52-3304), a method of limiting the melt viscosity of a wax (Japanese Patent Laid-Open Nos. H3-260659 and H3-122660), etc., are proposed.

However, because a release agent is inferior in the light transmittance as compared with a binder resin, in the case of color toners, on considering the reproducibility of OHP transparent images, a large amount of the release agent as in the case of a black and white toner cannot be added.

With regard to fixing, a wax exhibits the function by dissolving out from a toner and appears on the interface between a fixing roll and the toner. However, only a part of the wax dispersed in a toner is dissolved out from the toner and it is better that the wax exists on the surface of the toner or a release agent having a low melt viscosity is used so that at fixing, the release agent instantly moves to the interface between the toner and a fixing roll. However, these conditions become disadvantageous for the storage property, the powder fluidity in a copying machine or in the toner production process, and the granulation and the transferring property of the toner aggregated product by the use thereof for a long period of time.

Furthermore, in the case of forming full color images, the amount of the toners necessary for forming one sheet of image becomes very large in general as compared with the case of forming a black and white image. Thus, the amount of the toner particles remains in every portion such as a development portion, on a photoreceptor, on an intermediate transfer material, etc., become large. Since the remained toner particles sometimes contain a release agent, they are liable to weld to various portions, and these portions become nonfunctional in a short using period of time. Also, because in the case of a full color image formation, the uneven transfer of each color toner largely changes the hue of the color images formed, a higher transferring efficiency is required as compared with the case of a black and white or single color image formation wherein the color concentration only is changed.

To improve the transferring efficiency, various methods of adding an external additive in addition to adding a release agent in the inside of a toner have been investigated. In the case of a silica fine powder generally used as an external additive, it is particularly effective in improving the toner fluidity but it excessively increases the charging property of a negatively charging toner under low temperature and low humidity, and further reduces the charging property by taking in moisture under high temperature and high humidity, there is a problem that a large difference is caused between the charging properties in both cases. As the result thereof, the charging property cannot become the optimum in both under a high temperature and high humidity and under a low temperature and low humidity, and problems such as the inferior regeneration of image density, the formation of a fog on a photosensitive material, the formation of a background fog, staining of the inside of a copying machine are occurred.

For the purpose of solving these problems, a method of selecting a material for particles of an external additive or applying a surface treatment onto these particles of the material is proposed.

However, a sufficient effect has not been obtained by only using these inorganic fine powders. Also, an inorganic oxide added for improving the charging property and the fluidity of the power, such as titania the features that raising of electrostatic charges is higher than silica and also the electrostatic charge distribution becomes sharp owing to, perhaps, the low resistivity of titania. However, in the case of adding titania, a high electrostatic charge cannot be imparted to a toner, and also lowering of the conveying amount thereof, lowering of the density regeneration caused by lowering of electrostatic charges, and a fog on background portions are liable to occur.

Also, when the particle sizes of the external additive are reduced along with small-sizing of a toner, there is a possibility of causing an aggregation, which rather causes a problem of lowering the fluidity or the like of the toner.

For attaining both the improvement of the fluidity and the environmental dependence of electrostatic charging of a toner, it is attempted to add hydrophilic titanium and hydrophobic silica together (Japanese Patent Laid-Open No. S60-136755). By the method, each defect of hydrophilic silica and hydrophobic silica is temporarily restrained but according to their dispersed states, the toner is liable to be influenced by one of the two additives. Particularly, in the case of considering the maintenance thereof, it is difficult to stably control the dispersed structure at the surface of toner and by the stress on a sleeve, each feature of the hydrophilic silica or the hydrophobic titanium is liable to appear. That is, it is difficult to stably control each defect for a long period of time.

Then, a method of adding hydrophilic amorphous titanium oxide to a toner is proposed (Japanese Patent Laid-Open Nos. H5-204183 and H5-72797). Amorphous titanium oxide can be obtained by hydrolyzing a metal alkoxide or a metal halide using a CVD method (e.g., Kagakukogaku Ronbun Shu (Chemical Engineering Papers), Vol. 18, No. 3. 303–307(1992)). However, the titanium oxide obtained by such an electrolysis method can improve both the charging characteristics and the fluidity of a toner but contains many adsorbed water in the inside of the particles thereof and remains on a photoreceptor by itself at transferring. That is, the amorphous titanium oxide has the faults such as the amorphous titanium oxide has a strong sticking force to a photoreceptor, and only the amorphous titanium oxide remains on the photoreceptor without being transferred at transferring of the toner to form unfilled spots on the image formed or scratch the surface of the photoreceptor by the hard titanium oxide at cleaning.

Also, on the other hand, a method of treating the surface of titanium oxide by hydrolyzing a silane compound in an aqueous medium in a method of purifying titanium oxide by a wet method, taking out the titanium oxide in a state of restraining the occurrence of aggregation, and adding the titanium oxide thus treated to a toner is provided (Japanese Patent Laid-Open No. H5-188633).

When the silane compound treatment is applied to titanium oxide by the above-described method, the aggregated particles become less as compared with the hydrophilic method of titanium oxide in the prior art, that is, the improvement of the fluidity of the toner is obtained but, in this case, the charging level and the environmental dependence of the negative-charged toner are almost the same as those of a toner in the prior art, the improvements of the high-negative charging property and the environmental dependence of the toner desired in this invention are insufficient, and further the titanium oxide subjected to such a silane compound treatment gives a bad influence on the charging speed (the admix property of additional toner) and the electrostatic charge distribution.

For solving these problems, in Japanese Patent Laid-Open Nos. H6-95429, H6-102699, H6-266156, etc., it is proposed to use specific binder resins for preventing the embedding of an external additive in toner particles. Also, in Japanese Patent Laid-Open Nos. H6-51561, H6-208242, H6-250442, etc., it is proposed to use specific charge-controlling agents and external additives. However, these effects are insufficient and particularly in a full color development/transfer system of piling 4-color toner images, it is necessary to more precisely control the toner developing amounts, and thus there still remains a problem in the stabilization of the toner charging amounts for a long period of time. Particularly, in the case of using irregular-shaped toners containing a release agent, the charging faculties and the powder characteristics of the toners must be largely improved and thus it is necessary to precisely control the performance of the external additive. However, because a release agent exists in vicinity of the surfaces of toner particles, it is difficult to uniformly add the external additive to the toner particles.

SUMMARY OF THE INVENTION

The present invention has been made in view of the circumstances in related arts as described above. That is, the invention provides electrostatic latent image developing toners suitable for developers of full-color image formation, which are excellent in the fluidity, charging property, developing property, and transferring property of the toners, simultaneously satisfy the characteristics capable of preventing the formation of fog on a photosensitive material and the staining of the inside of a copying machine for a long period of time, improve the inconvenience in the system of fixing without substantially using oil, and can provide good images for a long period of time.

Also, the invention provides an image-forming process using the toners described above, which can form images having a high image quality for a long period of time even by applying oil-less fixing.

As the result of various investigations for attaining the techniques of this invention described above, the inventors have paid attention to the sticking state of an external additive to toner particles and have found that by keeping the distribution of a release agent in the toner particles and the sticking state of the external additive at specific conditions, the above-described techniques of the invention can be attained and have succeeded in accomplishing the invention based on the discovery.

That is, according to an aspect of the present invention, the electrostatic latent image developing toner for full color formation of the invention is an electrostatic latent image developing toner composed of toner particles containing a binder resin, a colorant, and a release agent, and at least one kind of an external additive, wherein the toner contains the release agent at least about 3%, the form of the toner particles is an irregular-shaped toner of $ML^2/A \geqq 125$, and when the emission voltage caused by the carbon originated in the binder resin of the toner particles is X and the emission voltage caused by the element originated in the external additive is Y, and when $X^{(2/3)}$ and Y are primary-regressed to the straight line passing through the origin, the correlation factor of the element originated in at least one kind of the external additive is more than 0.4.

Also, in the aspect of the invention described above, it is preferred from the viewpoint of the light transmittance, etc., of a fixed image that among the full color toners, that is among the cyan toner, the magenta toner, and the yellow toner, the difference of the correlation functions based on the same external additive is within about 0.1.

In the electrostatic latent image developing toner described above, it is preferred that the toner contains at least two kinds of external additives each having at least different particle size as the external additives.

Also, it is preferred that the external additive(s) are selected from a group of silica, titania, alumina, cerium oxide, strontium titanate, calcium carbonate, calcium phosphate, fluorine-containing resin fine particles, silicon-containing resin fine particles, and nitrogen-containing resin fine particles.

In this case, when silica is used as the external additive, because even a small amount of silica largely changes the charging property and the fluidity of powder, there is a possibility of giving bad influences if there is a dispersion of the stuck amount of silica among toner particles and thus, it is preferred that the correlation factor described above originated in silica is controlled to at least about 0.6.

As the specific external additive suitable for the condition of the above-described correlation factor used for the electrostatic latent image developing full color toners of this invention, there are titanium compounds having a specific gravity of from about 2.8 to 3.6 obtained by reacting at least a part or the whole of $TiO(OH)_2$ prepared by a wet method and a silane compound.

Also, as the binder resin, polyester is preferably used, and as the release agent used in this invention, a wax which is melted in the temperature range of from about 80 to 120° C. and has a melt viscosity in the range of from 1 to 200 centipoises is preferably used.

According to another aspect of the present invention, the image-forming process described in claim 2 of the invention includes a latent image-formation step of forming an electrostatic latent image on a photoreceptor, a developing step of forming a toner image by developing the latent image with a toner, a transfer step of transferring the toner image obtained onto a transfer material, and a fixing step of fixing the transferred image without substantially using an oil, wherein the above-described electrostatic latent image developing toner for full color of this invention is used.

In the toner of the invention, by containing a release agent at least about 3%, the toner image can be fixed without causing any problems in the step of fixing without substantially using an oil, and by making the form of the toner $ML^2/A \geqq 125$, spreading of the electrostatic charge distribution can be prevented, the release agent such as a wax in the toner is exposed on the surface of the toner, and the occurrence of inferior fixing can be prevented.

Also, by making the correlation factor of the element originated in at least one kind of the external additive more than about 0.4 when the emission voltage caused by the carbon originated in the binder resin of the toner particles is defined to be X and the emission voltage caused by the element originated in the external additive is defined to be Y, and $X^{(2/3)}$ and Y are primary-regressed to the straight line passing through the origin, the dispersion among the toner particles in the charging performance and the powder characteristics can be reduced and a high transfer efficiency can be attained.

In this case, the use of a titanium compound having a specific gravity of from about 2.8 to 3.6 obtained by reacting at least a part or the whole of $TiO(OH)_2$ prepared by a wet method and a silane compound or a silicone oil as the external additive is very effective for reducing the dispersion of the stuck amount of the external additive among the toner particles.

BRIEF DESCRIPTION OF THE DRAWINGS

One of the features defined in the invention is illustrated in the following drawings.

DETAILED DESCRIPTION OF THE INVENTION

Figure 1:
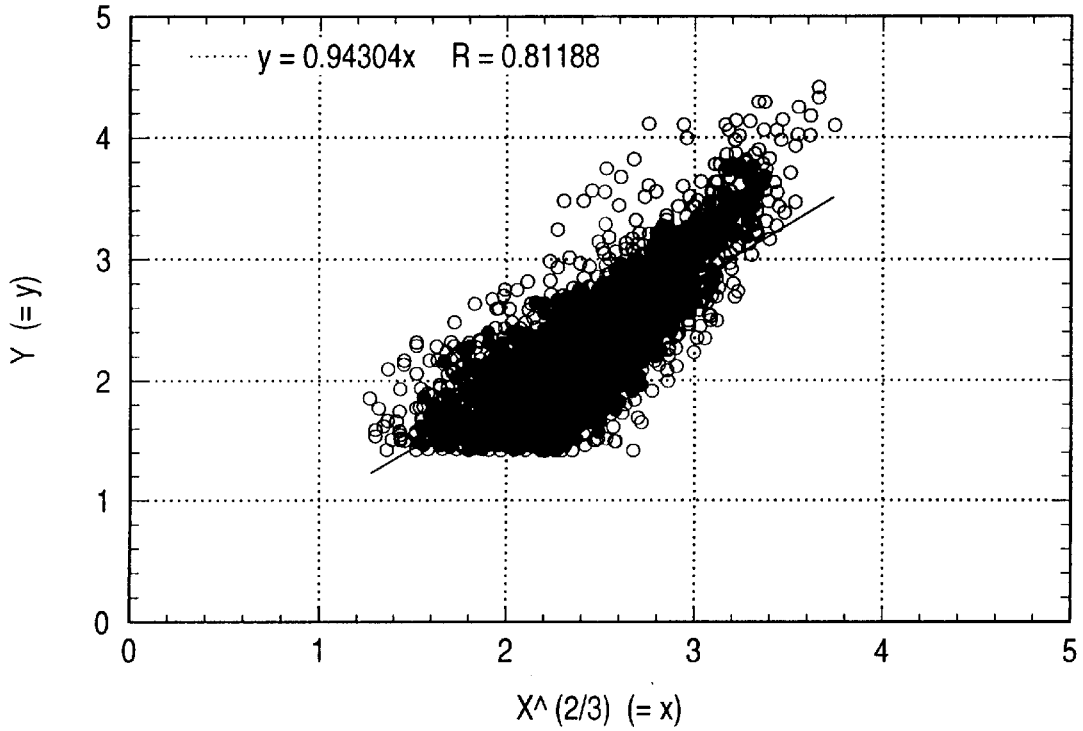
FIG. 1 is a graph that when the emission voltage caused by the carbon originated in the binder resin of the toner particles is defined to be X and the emission voltage caused by the element originated in the external additive is defined to be Y, and $X^{(2/3)}$ and Y are primary-regressed to the straight line passing through the origin, which shows an example that the correlation factor of each element originated in the external additive is at least about 0.4.

Then, the invention is described in detail.

The electrostatic latent image developing toner of this invention can be used for an electrostatic latent image developing developer for a full color image formation by singly or by combining with a carrier.

The electrostatic latent image developing toner composition of this invention is composed of toner particles containing a binder resin, a colorant, and a release agent, and external additive(s).

The shape factor $ML^2/A$ of the toner of the invention is calculated by the formula $$ML^2/A=(\text{maximum length})^2\times\pi\times100/(\text{area}\times4)$$

and in the case of a sphere, $ML^2/A$ becomes 100. As a specific measuring method of an irregular-shaped toner of $ML^2/A \geqq 125$, an image of 250 magnifications of a toner image from an optical microscope (Nikon Microphot-FXA, manufactured by Nikon Corp.) is taken in an image analyzer (LUZEX III, manufactured by Nireko K.K.), and $ML^2/A$ is measured.

There is no particular restriction on the production method of the toner of this invention if the toner produced satisfies the shape defined as described above (or claim 1 described later) and toner particles obtained by a known method can be used. For example, a method of toner forming particles by a knead-grinding method of kneading a binder resin, a colorant, and, if necessary, a release agent, a charge-controlling agent, etc., followed by grinding and classifying and changing the shape of the particles by a mechanical impact force or a heat energy; an emulsion-polymerization aggregating method of polymerizing the polymerizing monomer of a binder resin by an emulsion polymerization, mixing a dispersion of the polymerized product and a dispersion of a colorant and, if necessary, a release agent, a charge-controlling agent, aggregating the mixture, and heat-welding the aggregate to obtain toner particles; a suspension polymerization method of suspending a solution of the polymerizing monomer for obtaining a binder resin, a colorant, and, if necessary, a release agent, a charge-controlling agent, etc., in an aqueous medium followed by polymerizing; a dissolution suspension method of suspending a solution of a binder resin, a colorant, and if necessary, a release agent, a charge-controlling agent, etc., in an aqueous medium and granulating the suspension, etc. can be used. In these methods, the knead-grinding method is excellent in the point that the release agent is properly exposed on the surfaces of the toner particle.

Examples of the binder resin used in the invention include the homopolymers and copolymers of styrenes such as styrene, chlorostyrene, etc.; monoolefins such as ethylene, propylene, butylene, isoprene, etc.; vinyl esters such as vinyl acetate, vinyl propionate, vinyl benzoate, etc.; α-methylene aliphatic monocarboxylic esters such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.; vinyl ethers such as vinyl methyl ether, vinyl ethyl ether, vinyl butyl ether, etc.; vinyl ketones such as vinyl methyl ketone, vinyl hexyl ketone, vinyl isopropenyl ketone, etc. Particularly typical binder resins used in this invention include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, polyester, polyurethane, an epoxy resin, a silicone resin, polyamide, modified rosin, paraffin, waxes, etc. In these resins illustrated above, the case of using polyester as the binder resin is suitable from the viewpoint of obtaining a necessary image strength at a relatively low temperature. For example, a linear polyester resin made of a polycondensation product of bisphenol A and a polyhydric aromatic polycarboxylic acid as the main monomer constituents.

As the polyester used in this invention, the polymer synthesized by the polycondensation of a polyol component and a polycarboxylic acid component is preferably used. Examples of the polyol component used in the invention include ethylene glycol, propylene glycol, 1,3-butanediol, 1,4-butanediol, 2,3-butanediol, diethylene glycol, triethylene glycol, 1,5-butanediol, 1,6-hexanediol, neopentyl glycol, cyclohexane dimethanol, hydrogenated bisphenol A, a bisphenol A-ethylene oxide adduct, a bisphenol A-propylene oxide adduct, etc. Also, examples of the polyol component include maleic acid, fumaric acid, phthalic acid, isophthalic acid, terephthalic acid, succinic acid, dodecenylsuccinic acid, trimellitic acid, pyromellitic acid, cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methylene carboxypropanetetramethylenecarboxylic acid, and the anhydrides of them.

Also, the resins having a softening point of from about 90 to 150° C., a glass transition point of from about 55 to 75° C., a number average molecular amount of from about 2000 to 6000, a weight average molecular weight of from about 8000 to 150,000, an acid value of from about 5 to 30, and a hydroxyl group value of from about 5 to 40 are particularly preferably used.

Typical examples of the colorant for the toner of this invention include magnetic powders such as magnetite, ferrite, etc.; carbon black, Aniline Blue, Chalcoyl Blue, Chrome Yellow, Ultramarine Blue, Du Pont Oil Red, Quinoline Yellow, Methylene Blue Chloride, Phthalocyanine Blue, Malachite Green Oxalate, lump black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, C.I. Pigment Blue 15:3, etc.

The toner of the invention is required to contain a release agent and as the release agentnt, a wax, etc., are preferred. Examples of the wax used in this invention include a paraffin wax and the derivatives thereof, a microcrystalline wax and the derivatives thereof, a montan wax and the derivatives thereof, a Fischer-Tropsch wax and the derivatives thereof, a polyolefin wax and the derivatives thereof, etc. The derivatives in this case include the oxides, the polymers with a vinyl monomer, and the graft modified products. As other release agent, alcohols, fatty acids, vegetable-based waxes, animal-based waxes, mineral-based waxes, ester waxes, acid amides, etc., can be utilized.

When a wax is used as the release agent, as the characteristics thereof, it is necessary that in the DSC curve measured by a differential scanning calorimeter, endothermic initiation temperature is at least about 50° C., and preferably at least about 60° C. When the endothermic initiation temperature is lower than 50° C., the aggregation of the toner occurs in a copying machine and a toner bottle. The endothermic initiation temperature of a wax depends upon the low molecular weight in the molecular weight distribution constituting the wax and the kind and the amount of the polar groups of the structure thereof. In general, when the molecular weight of a wax is high, the melting point and the endothermic initiation temperature of the wax are increased but in this case, the low melting temperature and the low viscosity intrinsic to a wax are lost. Accordingly, it is effective to selectively remove low molecular weight wax only in the molecular weight distribution of a wax, and as the method thereof, there are methods of a molecular distillation, a solvent separation, a gas chromatographic separation, etc.

It is desirable that a wax used in this invention is melted in the temperature range of from about 80 to 120° C. and the melt viscosity thereof is in the range of from about 1 to 200 centipoises, and more preferably in the range of from about 1 to 100 centipoises. When the melting temperature of a wax is lower than 80° C., the changing temperature of the wax is too low, whereby the blocking resistance of the toner is inferior and the developing property is deteriorated when the inside temperature of a copying machine is increased. On the other hand, when the melting temperature exceeds 120° C., the changing temperature of the wax is too high, whereby fixing at a low temperature becomes difficult, which is undesirable from the viewpoint of energy saving. Also, when the melt viscosity of a wax is higher than 200 centipoises, dissolving out of the wax from the toner is weak, whereby the releasing property at fixing becomes insufficient.

It is important that the addition amount of the wax to a toner is at least about 3% by weight. The toner can contain a wax up to the amount of about 30% by weight but a more preferred content of the wax is from about 4 to 10% by weight. When the content of the wax is less than 3% by weight, a sufficient fixing latitude (a fixing roll temperature range capable of fixing without causing offset of a toner) is not obtained, and with the increase of the content of a wax over about 15% by weight, the amount of the liberated wax gradually released from the toner increases to deteriorate the powder fluidity of the toner and also the liberated wax sticks to the surface of a photoreceptor for forming electrostatic latent images, whereby the possibility that an electrostatic latent image cannot be accurately formed on the surface is increased. Also, because a wax is inferior in the transparency to a binder resin, the transparency of an OHP image, etc., is lowered to form a blackish projected image.

The toner of the invention may contain a charge-controlling agent as required. As the charge-controlling agent, a known material can be used but an azoic metal complex compound, a metal complex compound of salicylic acid, or a resin-type charge-controlling agent having a polar group can be preferably used. In the case of producing the toner by a wet production method, a charge-controlling agent made of a material which is reluctant to be dissolved in water is preferred in the points of controlling an ionic strength and preventing the pollution of the waste water.

The toner particles of this invention have suitably a mean particle size of from about 3 to 10 $\mu$m and preferably in the range of from about 4 to 8 $\mu$m. When the mean particle size of the toner exceeds 10 $\mu$m, the toner particles cannot faithfully develop dot and line latent images and it sometimes happens that the regeneration of a photographic image or the regeneration of fine lines is inferior. Also, when the mean particle size is less than 3 $\mu$m, the surface area per toner unit becomes large, the control of charging and the fluidity of the toner becomes difficult, and it sometimes happens that stable images cannot be obtained.

In this invention, when the emission voltage of carbon originated in the binder resin of the toner particles is X, the emission voltage caused by the element originated in the external additive of the toner particles is Y, and when $X^{(2/3)}$ and Y are primary regressed to the straight line passing through the origin, the correlation factor of each element originated in the external additive is calculated as follows. That is, the elemental analysis of each toner particle was practiced by Particle Analyzer PT-1000 (manufactured by Yokogawa Electric Corp.), based on the data of about 1000 toner particles, the primary regression was carried out to the straight line passing through the origin, and the correlation factor thereof was calculated. However, in the case of calculating the regression formula, particles of X=0, Y=0 were excluded.

The correlation factor of each element originated in the external additive approaches 1.0 as the external additive more uniformly stuck to all the toner particles and it is desirable that the correlation factor is close to 1.0 as much as possible. When the correlation factor becomes less than 0.4, the difference in the charging performance and the difference in the powder fluidity between the toner particles stuck with a large amount of the external additive and the toner particles stuck with a small amount of the external additive become large.

Figure 2:
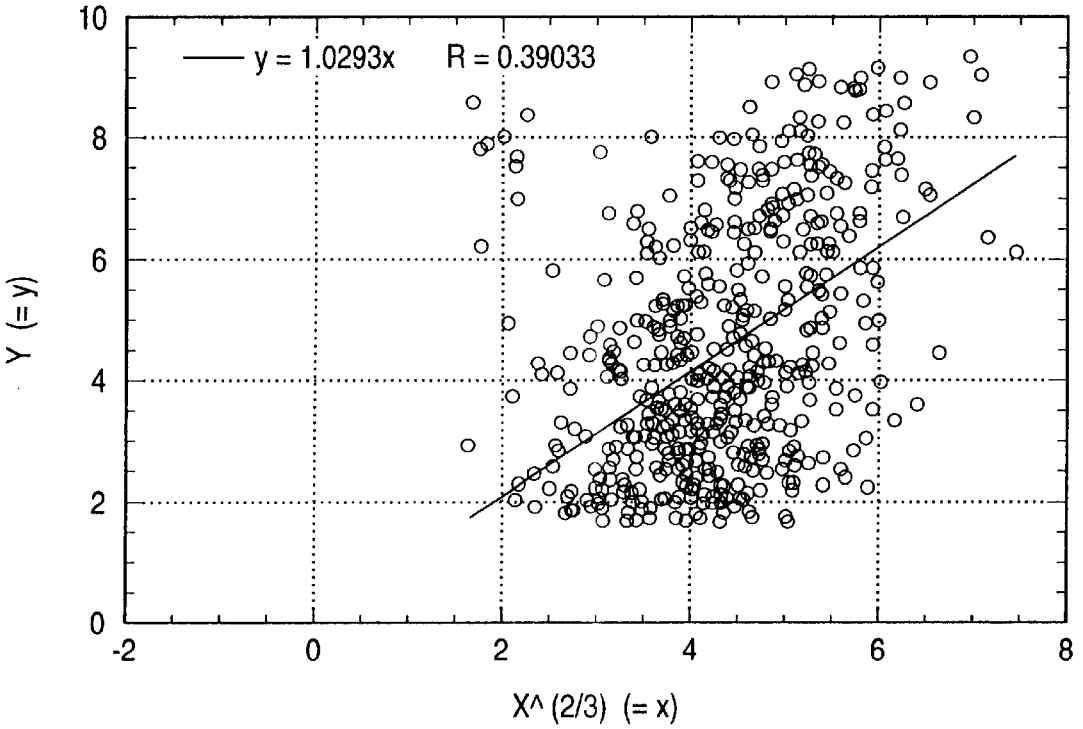
FIG. 2 is a graph that when the emission voltage caused by the carbon originated in the binder resin of the toner particles is defined to be X and the emission voltage caused by the element originated in the external additive is defined to be Y, and $X^{(2/3)}$ and Y are primary-regressed to the straight line passing through the origin, which shows an example that the correlation factor of each element originated in the external additive is less than 0.4.

FIG. 1 is a graph showing the toner particles wherein when the emission voltage of carbon originated in the binder resin of the toner particles is X, the emission voltage caused by the element originated in the external additive of the toner particles is Y, and when $X^{(2/3)}$ and Y are primary regressed to the straight line passing through the origin, the correlation factor of each element originated in the external additive is close to 1.0. When the toner particles were observed by an ordinary scanning type electron microscope, it was found that the external additive uniformly stuck to the surfaces of the toner particles. Also, FIG. 2 is a graph showing toner particles wherein the correlation factor thereof is less than 0.4. By similarly observing the toner particles, it was found that the external additive formed aggregates and was not uniformly stuck to the surfaces of the toner particles.

The method of obtaining the toner particles satisfying the external additive structure that when the emission voltage of carbon originated in the binder resin of the toner particles is X, the emission voltage caused by the element originated in the external additive of the toner particles is Y, and when $X^{(2/3)}$ and Y are primary regressed to the straight line passing through the origin, the correlation factor of the element originated in at least one kind of the external additive, can be attained by employing a known blending apparatus and by suitably designing the step of blending. In particular, as the external additives, it is preferred to use a combination of at least two kinds of external additives each having different particle sizes. As a preferred blending method described above, there is a multistage addition method of blending particularly a 1st external additive and the matrix toner particles by a known method and further blending the blend with from a 2nd external additive to an nth external additive successively. Also, a method of using inorganic fine particles showing less aggregation as the 1st external additive, a method of increasing the blending strength as compared with a conventional blending method etc. are suitably used. The addition amounts of the external additives have a limit to some extent in the selection by the balance with the charging characteristics, the powder characteristics, the cost, the aggregating state of the external additives, the defects by liberated external additives and a method of increasing the addition amount of the 1st external additive, etc., is effective.

A method of pre-stirring by a weak energy at blending is also effective. Furthermore, a wet external addition method of blending the external additive in the dispersion of the toner at the production of the toner is also effective. A method of previously stirring an external additive alone by a blending apparatus and thereafter, adding the toner, a method of classifying the toner while adding a small amount of an external additive at classifying the toner and thereafter, blending the toner with an external additive by the method as described above, etc., are also effective.

With regard to the condition of the toner particles which can easily attain uniform sticking of an external additive, it is effective that concave portions in which the inorganic fine particles having large particle sizes are fixed are less.

As the inorganic fine particles used as the external additive in the toner of this invention, known materials can be used. Examples of the material of the inorganic fine particles include silica, alumina, titania, calcium carbonate, magnesium carbonate, calcium phosphate, cerium oxide, etc. Also, according to the purposes, a known surface treatment may be applied to the surfaces of the inorganic resin fine particles.

Particularly, as the 1st external additive, a titanium compound having a specific gravity of from about 2.8 to 3.6 obtained by reacting a part or the whole of $TiO(OH)_2$ prepared by a wet method and a silicone oil is preferred. Generally, in the production method of titanium oxide by an ordinary wet method, titanium oxide is produced by a chemical reaction in a solvent, and the method can be classified into a sulfuric acid method and a hydrochloric acid method. In the sulfuric acid method, to be brief, the following reaction proceeds in a liquid phase and insoluble $TiO(OH)_2$ is prepared by a hydrolysis;

$$FeTiO_3+2H_2SO_4 \rightarrow FeSO_4+TiOSO_4+2H_2O$$

$$TiOSO_4+2H_2O \rightarrow TiO(OH)_2+H_2SO_4$$

Also, in the hydrochloric acid wet method, titanium tetrachloride is prepared by chlorination by the same manner as a dry method. Thereafter, the product is dissolved in water and hydrolyzed while adding a strong base to prepare $TiO(OH)_2$. The reaction can be simplified as follows:

$$TiCl_4+H_2O \rightarrow TiOCl_2+2HCl$$

$$TiOCl_2+2H_2O \rightarrow TiO(OH)_2+2HCl$$

The titanium compound suitable as the external additive in this invention is prepared by reacting $TiO(OH)_2$ prepared by the above-described wet method and a silane compound in a wet step followed by drying.

As the silane compound described above, a water-soluble silane compound can be used.

As such a silane compound, the compound represented by the following formula can be used;

$$RaSiX_{4-a}$$

wherein, a is an integer of from 0 to 3; R represents a hydrogen atom, or an organic group such as an alkyl group, an alkenyl group, etc.; and X represents a chlorine atom or a hydrolyzing group such as a methoxy group, an ethoxy group, etc. Also, chlorosilane, an alkoxysilane, silazane, and special silylating agents can be used. Specific examples of the silane compound used in the invention include methyl trichlorosilane, methyl dichlorosilane, dimethyl dichlorosilane, trimethyl chlorosilane, phenyl trichlorosilane, diphenyl dichlorosilane, tetramethoxysilane, methyl trimethoxysilane, dimethyl dimethoxysilane, phenyl trimethoxysilane, diphenyl dimethoxysilane, tetraethoxysilane, methyl triethoxysilane, dimethyl diethoxysilane, phenyl triethoxysilane, diphenyl diethoxysilane, isobutyl trimethoxysilane, tert-butyl trimethoxysilane, decyl trimethoxysilane, hexamethyldisilazane, etc. In these compounds, the compounds preferably used as the treating agent in this invention include dimethyl dimethoxysilane, methyl triethoxysilane, isobutyl trimethoxysilane, decyl trimethoxysilane, etc.

Also, the addition amount of the silane compound can be properly selected according to a desired introducing amount of the titanium compound as the external additive but is generally from about 1 to 250 parts by weight, and preferably from about 50 to 200 parts by weight to 100 parts by weight of $TiO(OH)_2$.

In addition, after drying the titanium compound may be subjected to a composite treatment using other compound and in this case, a treating agent which is not water-soluble, such as a silicone oil, etc., can be used.

According to the method described above, because a burning step of several hundreds ° C. is not used, strong bonding of Ti each other is hard to occur, and the titanium compound particles can be obtained in an almost primary particle state without forming aggregation. Also, in the method, because the titanium compound is obtained by directly reacting $TiO(OH)_2$ and a silane compound, the silane compound can effectively contribute to the treatment. That is, in treated titanium oxide obtained in the prior art, the critical value of the treatment amount contributing to the charging faculty was low, but in the titanium compound obtained by the above-described method, the critical value is high, and although the effect thereof differs to some extent according to the particle size before treatment, the treatment effect up to about 3 times (about 50 to 70% to the titanium compound) the amount of a usual product can be obtained. Consequently, by the treating amount of the silane compound, electrostatic charging of the toner can be controlled and also impartable charging faculty can be greatly improved as compared with titanium oxide treated by a usual method. Furthermore, because the amount of the excessive silane compound which does not contribute to the reaction becomes less and the occurrence of a side-reaction among the silane compounds is less, even when the treating amount is increased, high electrostatic charging can be obtained without sacrificing the charging speed and the charge distribution. In this case, the titanium compound used as the external additive has a mean primary particle size of not larger than about 100 nm, and preferably in the range of from about 10 nm to 70 nm.

When the above-described treatment method in the invention is compared with an ordinary treatment method of titanium oxide, in an ordinary method, after obtaining $TiO(OH)_2$, steps of water washing and filtration are repeatedly applied, titanium oxide is obtained by burning, and after breaking and grinding the titanium oxide, a surface treatment with a silane compound or the like is applied as required. In the preparation method of titanium oxide, there is a serious fault when super-heated in the burning step, Ti particles are sintered with each other owing to the bonding strength among Ti particles and many aggregations occur.

To solve the fault, many attempts such as strengthening of wet grinding, the application of a treating agent reaction before drying, etc. have been made but it has not yet been succeeded in breaking the aggregates to primary particles. Even when the surface-treated titanium oxide obtained by such an ordinary method is applied to a toner as an external additive thereof, it is difficult to uniformly coat the surfaces of the toner particles, and for example, even when the titanium oxide is used together with silica particles as the external additive of a toner, a preferred fluidity of the toner cannot be obtained, and further scratches of a photosensitive material and filming which are considered to be caused by the aggregates of the titanium oxide occur.

Also, in the silane compound-treated titanium oxide by an ordinary production method, there is a limit in the treatment efficiency of the silane compound. In general, by increasing the amount of a silane compound, the charging property imparting faculty is increased but there is a tendency that the faculty thereof is saturated by the treating amount of from about 15 to 20% to the amount of titanium oxide. Therefore, even when the amount of a silane coupling agent, etc., generally used as a silane compound is increased for the purpose of imparting a high electrostatic charge, not only a high electrostatic charge is not obtained but also further increase of aggregated particles occurs, and further when such a silane coupling agent, etc., is added to a toner, lowering of the charging speed, broadening of the charge distribution, etc., are accompanied.

As described above, the external additive made of titanium oxide subjected to an ordinary silane compound treatment is not at the level of satisfying all the improvement to the amount of the aggregated particles, the high charge-imparting faculty, the charging speed, and the charge distribution, and it can be seen that the above-described method of directly reacting a silane compound with the titania particles obtained by a wet method is excellent.

As mentioned above, it is preferred that the use of particles of large particle sizes and particles of small particle sizes together as the external additives assists small sizing of the toner particles for attaining a high quality image and preventing inferior transferring accompanied by the increase of a sticking force caused by existing a surface lubricant in the vicinity of the surfaces of the toner particles. In this case, the fine particles of large particle sizes having a BET specific area of from about 20 to 250 $m^2/g$ can be used as the fine particles subjected to various surface treatments, and the fine particles having a BET specific area of from 20 to 100 $m^2/g$ are particularly preferred. When the BET specific area is less than 20 $m^2/g$, the image unevenness caused by lowering the fluidity of the toner is liable to occur, and also the sticking force thereof to the toner is hard to become strong and the particles are liable to be released from the toner, which causes the formation of scratches of photosensitive materials and unfilled spots in the images. On the other hand, when the surface area exceeds 250 $m^2/g$, it is difficult to show the effect as a transferring aid and particularly, in the toner of the lowermost layer, an inferior transfer is liable to occur.

The amount of the fine particles of the large particle sizes added to the toner is in the range of from about 0.1 to 5.0 parts by weight, and preferably from about 0.2 to 2.0 parts by weight to 100 parts by weight of the toner. When the amount thereof is less than 0.1 part by weight, the effect of improving the inferior transfer is insufficient, and when the amount exceeds 5.0 parts by weight, the particles are easily released from the toner, which causes the formations of scratches on a photosensitive material and unfilled spots in the images.

Also, according to the purposes, resin fine particles etc. may be added to the toner.

On the other hand, when the toner of the invention is used for a two-component developer, there is no restriction on the carrier which can be used together with the toner, and a known carrier can be used. For example, there is a resin-coated carrier made of a core material having thereon a resin coating layer. Also, a carrier made of a matrix resin having dispersed therein an electrically conductive powder may be used.

Examples of the coating resin and the matrix resin used for the above-described coated carrier include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, a vinyl chloride-vinyl acetate copolymer, a styrene-acrylic acid copolymer, a straight silicone resin made of an organosiloxane bond or the modified products thereof, a fluorine resin, polyester, polyurethane, polycarbonate, a phenol resin, an amino resin, a melamine resin, a benzoguanamine resin, a urea resin, an amide resin, an epoxy resin, etc., but the invention is not limited to these resins.

Examples of the electrically conductive material used for the carrier include metals such as gold, silver, copper, etc.; carbon black, titaniumoxide, zinc oxide, barium sulfate, aluminum borate, potassium titanate, tin oxide, etc., but the material used in this invention is not limited to these materials.

As the core material of the carrier, there are magnetic metals such as iron, nickel, cobalt, etc.; magnetic oxides such as ferrite, magnetite, etc.; glass beads, etc. For controlling the volume specific resistance using a magnetic brush method, a magnetic material is preferably used.

The mean particle size of the carrier core material is generally from about 10 to 500 $\mu$m, and the core material of a spherical form having a mean particle size of from about 30 to 100 $\mu$m is preferably used.

Also, as a method of resin-coating the surface of the carrier core material, there are a dipping method of dipping the carrier core in a solution for forming the coating layer, a spray method of spraying a solution for forming the coating layer onto the surface of the carrier core material, a fluid-bed method of spraying a solution for forming the coating layer onto the carrier core in a state of floating by flowing air, a kneader coater method of mixing the carrier core material and a solution for forming the coating layer in a kneader coater and removing the solvent, etc.

The following examples are intended to specifically illustrate the present invention but not to limit the invention in any way. In addition, all parts in the following explanations, unless otherwise indicated, are by weight.

The particle sizes of the toners of this invention are measured by a particle size measurement apparatus, TAII, manufactured by Coulter Counter Corporation at an aperture diameter of 100 $\mu$m.

Also, about the charged amount of the toner used in the invention, using a blow-off charged amount measurement apparatus manufactured by Toshiba Chemical K.K., the charged amount of the developer in a developing apparatus is measured.

Also, the specific gravity of the titanium compound used in the invention is measured according to JIS-K-0061, 5-2-1 using a Le Chatelier pycnometer. The operation is as follows.

(1) In the Le Chatelier pycnometer is placed about 250 ml of water and it is adjusted so that the meniscus is in the position of the scale.

(2) The pycnometer is immersed on a water bath kept at a constant temperature and when the temperature becomes 20.0±0.2° C., the position of the meniscus is correctly read by the scale of the pycnometer. (accuracy 0.025 ml)

(3) About 100 g of sample is weighed at the figure of 1 mg and the mass is defined to be W.

(4) The sample thus weighed is placed in the pycnometer and bubbles are removed.

(5) The pycnometer is immersed in water bath kept at a constant temperature, the temperature is kept at 20.0±0.2° C., and the position of the meniscus is correctly read by the scale of the pycnometer. (accuracy 0.025 ml)

(6) The specific gravity is calculated by he following formula;

$$D=W/(L2-L1)$$

$$S=D/0.9982$$

wherein; D: Density of the sample (20° C.) (g/cm$^3$)

S: Specific gravity of the sample (20/20° C.)

W: Apparent mass (g) of the sample

L1: Read of the meniscus (20° C.) (ml) before placing the sample in the pycnometer.

L2: Read of the meniscus (20° C.) (ml) after placing the sample in the pycnometer.

0.9982: Density (g/cm$^3$) of water at 20° C.

[Production method of toner A]

Linear polyester 92 parts (linear polyester obtained from terephthalic acid/bisphenol A-propylene oxide adduct/cyclohexane dimethanol; Tg=64° C., Mn=3,500, Mw=35,000, acid value=11, hydroxyl value=24)

Cyan pigment (C.I. Pigment Blue 15:3) 3 parts

Ester wax 5 parts (melt viscosity 100 cs at endothermic initiation temperatures 60° C., 120° C.)

The mixture of the above components is kneaded by an extruder, after rolling, cooling, and grinding the slab obtained, the ground product is finely ground by a jet mill. Furthermore, crude powder and fine powder classified by an air classifier are removed to obtain the classified product having a mean particle size of 6.5 $\mu$m.

[Production method of toner B]

Linear polyester 92 parts (linear polyester obtained from terephthalic acid/bisphenol A-ethylene oxide adduct/cyclohexane dimethanol; Tg=62° C., Mn=3,200, Mw=30,000, acid value=18, hydroxyl value=24)

Cyan pigment (C.I. Pigment Blue 15:3) 3 parts

Ester wax 5 parts (melt viscosity 110 cs at endothermic initiation temperatures 60° C., 120° C.)

The mixture of the above components is kneaded by an extruder, after rolling, cooling, and grinding the slab obtained, the ground product is finely ground by a jet mill. Furthermore, crude powder and fine powder classified by an air classifier while adding 1 part of an external additive A are removed to obtain the classified product having a mean particle size of 6.5 $\mu$m.

[Production method of toner C]

Linear polyester 87 parts (linear polyester obtained from terephthalic acid/bisphenol A-propylene oxide adduct/cyclohexane dimethanol; Tg=64° C., Mn=3,500, Mw=35,000, acid value=11, hydroxyl value=24)

Cyan pigment (C.I. Pigment Blue 15:3) 3 parts

Polypropylene wax 10 parts (not melt at endothermic initiation temperatures 110° C., 120° C.)

By following the same procedure as the case of producing toner A using the mixture of the above-described components, toner C is obtained.

In each of the toner A, the toner B, and the toner C, 3 parts of the cyan pigment is replaced with 10 parts of a yellow pigment (Y 180), 5 parts of a magenta pigment (C.I. Pigment Red 122), or 5 parts of carbon black (#25, made by Cabot Co.) respectively to obtain toners of four colors in all.

In the invention, titanium oxide formed by a wet method, that is, titanium oxide prepared by a sulfuric acid method or a hydrochloric acid method can be used but titanium oxide used in the examples is obtained by a wet precipitation method of using ilmenite as an ore, dissolving ilmenite in sulfuric acid, and after removing iron components, hydrolyzing $TiOSO_4$ to form $TiO(OH)_2$ is used.

The key techniques of the preparation described above are the hydrolysis for forming nuclei, the dispersion control, and water washing, and particular, the pH control (neutralization of acid) in the dispersion treatment and the control of the slurry concentration determine the primary particles of the titanium compound described below and the control of a high level is necessary.

[Preparation method of external additive A]

A mixture of 100 parts of $TiO(OH)_2$ formed by the above-described method and 40 parts of isobutyl trimethoxysilane is reacted by heating. Thereafter, the product is washed with water, filtered, and dried at 120° C., and then soft aggregates formed are loosened by a pin mill to obtain titanium compound A having a mean particle size of 45 nm and a specific gravity of 3.2.

[Preparation method of external additive B]

Titanium oxide having a mean particle size of 30 nm is obtainedby washing with water, filtering, andburning $TiO(OH)_2$ prepared by the above-described method. Thereafter, the titanium oxide is ground by a jet mill followed by dispersing, after mixing 100 parts of titania and 40 parts of isobutyl trimethoxysilane, the mixture is wet-ground by a sand grinder, stirred by a kneader, and dried by heating to obtain external additive B (specific gravity 3.9).

Then, a method of preparing each electrostatic latent image developer by adding the external additive to each toner and mixing the toner with a carrier is described below and the method is carried out for each of four-color toners.

EXAMPLE 1

After mixing 100 parts by weight of the toner particle A and 1.0 part by weight of the external additive A as a 1st external additive by a Henschel mixer for 1 minute at an air speed of 10 meters/second and for 25 minutes at an air speed of 30 meters/second, 1.0 part by weight of hexamethyl disilazane-treated silica having a BET specific area of 50 $m^2/g$ is added to the mixture as a 2nd external additive and the resultant mixture is mixed by a Henschel mixer for 1 minute at an air speed of 10 meters/second and for 5 minutes at an air speed of 30 meters/second to prepare a toner.

Also, the toner is mixed with a ferrite carrier having a mean particle size of 50 $\mu$m coated with 1% polymethyl methacrylate (made by Soken Kagaku K.K.) by a V-type blender so that the toner concentration becomes 5% by weight to prepare an electrostatic latent image developer 1.

EXAMPLE 2

By following the same procedure as Example 1 except that isobutylsilane-treated silica having a BET specific area of 100 $m^2/g$ is used in place of the external additive A and the external additive B is used in place of the 2nd external additive, an electrostatic latent image developer 2 is prepared.

EXAMPLE 3

By following the same procedure as Example 1 except that the amount of the external additive A is changed to 2.5 parts by weight, an electrostatic latent image developer 3 is prepared.

EXAMPLE 4

By following the same procedure as Example 3 except that the external additive B is used in place of the external additive A, an electrostatic latent image developer 4 is prepared.

EXAMPLE 5

By following the same procedure as Example 1 except that isobutylsilane-treated silica is used in place of the 2nd external additive, an electrostatic latent image developer 5 is prepared.

EXAMPLE 6

By following the same procedure as Example 1 except that the external additive B is used in place of the 2nd external additive, an electrostatic latent image developer 6 is prepared.

EXAMPLE 7

By following the same procedure as Example 1 except that the toner B is used in place of the toner A, an electrostatic latent image developer 7 is prepared.

EXAMPLE 8

By following the same procedure as Example 3 except that in the blending method, the 1st external additive is added in five steps at 0.5 part by weight in each step, and in each step, the mixture is mixed by a Henschel mixer for 1 minute at an air speed of 10 meters/second and for 5 minutes at an air speed of 30 meters/second, an electrostatic latent image developer 8 is prepared.

EXAMPLE 9

By following the same procedure as Example 1 except that a toner is prepared by previously mixing 1.0 part by weight of the external additive A as the 1st external additive and 1.0 part by weight of hexamethyldisilazane-treated silica having a BET specific area of 50 $m^2/g$ by a Henschel mixer for 1 minute at an air speed of 10 meters/second, adding thereto 100 parts by weight of the toner A, and mixing the resultant mixture for 1 minute at an air speed of 10 meters/second and for 15 minutes at an air speed of 30 meters/second, an electrostatic latent image developer 9 is prepared.

EXAMPLE 10

By following the same procedure as Example 1 except that in the blending method of hexamethyldisilazane-treated silica having a BET specific area of 50 $m^2/g$ as the 2nd external additive, the silica is added in two steps at 0.5 part by weight in each step, and in each step, the mixture is mixed by a Henschel mixer for 1 minute at an air speed of 10 meters/second and for 5 minutes at an air speed of 30 meters/second, an electrostatic latent image developer 10 is prepared.

EXAMPLE 11

By following the same procedure as Example 1 except that a toner is prepared by using the toner B in place of the toner A, previously mixing the toner B with 1.0 part by weight of the external additive A as the 1st external additive, 1.0 part by weight of hexamethyldisilazane-treated silica having a BET specific area of 50 $m^2/g$ as the 2nd external additive, and 0.5 part by weight of vinylidene fluoride fine particles having a mean particle size of 300 nm as the 3rd external additive by a Henschel mixture for 1 minute at an air speed of 10 meters/second, adding thereto 100 parts by weight of the toner A, and mixing the resultant mixture for 1 minute at an air speed of 10 meters/second and for 15 minutes at an air speed of 30 meters/second, an electrostatic latent image developer 11 is prepared.

EXAMPLE 12

By following the same procedure as Example 11 except that the toner B is used in place of the toner A, and 1.0 part by weight of the external additive A, 1.0 part by weight of isobutylsilane-treated silica having a BET specific area of 100 $m^2/g$, and 0.5 part by weight of hexamethyldisilazane-treated silica having a BET specific area of 50 $m^2/g$ are used, an electrostatic latent image developer 12 is prepared.

EXAMPLE 13

A toner is obtained by adding the external additive A to 100 parts by weight of the toner B in five steps at 0.5 part by weight in each step and in each step, the mixture is mixed by a Henschel mixer for 1 minute at an air speed of 10 meters/second and for 5 minutes at an air speed of 30 meters/second. Thereafter, by following the same procedure as Example 1 using the toner obtained, an electrostatic latent image developer 13 is prepared.

COMPARATIVE EXAMPLE 1

By following the same procedure as Example 1 except that the toner C is used in place of the toner A and two kinds of the external additives and the toner are mixed by a Henschel mixer for 5 minutes at an air speed of 30 meters/second, an electrostatic latent image developer 14 is prepared.

COMPARATIVE EXAMPLE 2

By mixing the toner, the 1st external additive, and the 2nd external additive of the compositions as in Example 1 by a Henschel mixer for 1 minute at an air speed of 30 meters/second, an electrostatic latent image developer 15 is prepared.

COMPARATIVE EXAMPLE 3

The toner, the 1st external additive, and the 2nd external additive of the compositions as in Example 4 by a Henschel mixer for 1 minute at an air speed of 30 meters/second, an electrostatic latent image developer 16 is prepared.

The properties of the toners described above are shown in Table 1 and Table 2 below. $ML^2/A$ (shape of toner), $r_1$, $r_2$, and $r_3$ (wherein, $r_1$: the correlation factor of each element originated in the 1st external additive, $r_2$: the correlation factor of each element originated in the 2nd external additive, $r_3$: the correlation factor of each element originated in the 3rd external additive. In this case, when the 1st external additive and the 2nd external additive are originated in a same element, they are expressed as the 1st external additive.) Were measured by the methods described above in the specification. With regard to the storability, in the toners of Examples 1 to 13 and Comparative Examples 1 to 3, 20 g of each toner was placed in a polyethylene-made bottle having a volume of 150 cc and the bottle was stored in a bath kept at a constant temperature of 47° C. for 24 hours. Then, after cooling to room temperature, the toner was taken out from the bottle, the welding state among the toner particles was observed, and the storability was evaluated by the following standards.

No welding occurred: ○

Welding occurred but no problem for practical use: Δ

Welding became a problem for practical use: X

TABLE 1

(Toner Properties)

| | Developer | Color | $ML^2/A$ | $r_1$ | $r_2$ | $r_3$ | Storability |
|---|---|---|---|---|---|---|---|
| Example 1 | 1 | Yellow | 140.0 | 0.61 | 0.80 | — | ○ |
| | | Magenta | 141.0 | 0.60 | 0.79 | — | ○ |
| | | Cyan | 140.2 | 0.62 | 0.80 | — | ○ |
| | | Black | 139.5 | 0.58 | 0.75 | — | ○ |
| Example 2 | 2 | Yellow | 140.0 | 0.43 | 0.65 | — | ○ |
| | | Magenta | 141.0 | 0.45 | 0.66 | — | ○ |
| | | Cyan | 140.2 | 0.51 | 0.62 | — | ○ |
| | | Black | 139.5 | 0.48 | 0.65 | — | ○ |
| Example 3 | 3 | Yellow | 140.0 | 0.56 | 0.82 | — | ○ |
| | | Magenta | 141.0 | 0.50 | 0.80 | — | ○ |
| | | Cyan | 140.2 | 0.57 | 0.75 | — | ○ |
| | | Black | 139.5 | 0.50 | 0.78 | — | ○ |
| Example 4 | 4 | Yellow | 140.0 | 0.46 | 0.63 | — | ○ |
| | | Magenta | 141.0 | 0.45 | 0.64 | — | ○ |
| | | Cyan | 140.2 | 0.44 | 0.63 | — | ○ |
| | | Black | 139.5 | 0.42 | 0.61 | — | ○ |
| Example 5 | 5 | Yellow | 140.0 | 0.60 | 0.88 | — | ○ |
| | | Magenta | 141.0 | 0.58 | 0.75 | — | ○ |
| | | Cyan | 140.2 | 0.65 | 0.78 | — | ○ |
| | | Black | 139.5 | 0.66 | 0.83 | — | ○ |
| Example 6 | 6 | Yellow | 140.0 | 0.63 | — | — | ○ |
| | | Magenta | 141.0 | 0.61 | — | — | ○ |
| | | Cyan | 140.2 | 0.62 | — | — | ○ |
| | | Black | 139.5 | 0.64 | — | — | ○ |
| Example 7 | 7 | Yellow | 143.8 | 0.72 | 0.80 | — | ○ |
| | | Magenta | 143.3 | 0.70 | 0.83 | — | ○ |
| | | Cyan | 142.0 | 0.70 | 0.82 | — | ○ |
| | | Black | 142.0 | 0.72 | 0.79 | — | ○ |
| Example 8 | 8 | Yellow | 140.0 | 0.67 | 0.83 | — | ○ |
| | | Magenta | 141.0 | 0.65 | 0.82 | — | ○ |
| | | Cyan | 140.2 | 0.63 | 0.84 | — | ○ |
| | | Black | 139.5 | 0.67 | 0.83 | — | ○ |

TABLE 2

| | oper | Devel-Color | $ML^2/A$ | $r_1$ | $r_2$ | $r_3$ | Storability |
|---|---|---|---|---|---|---|---|
| Example 9 | 9 | Yellow | 140.0 | 0.65 | 0.81 | — | ○ |
| | | Magenta | 141.0 | 0.62 | 0.81 | — | ○ |
| | | Cyan | 140.2 | 0.63 | 0.83 | — | ○ |
| | | Black | 139.5 | 0.64 | 0.78 | — | ○ |
| Example 10 | 10 | Yellow | 140.0 | 0.78 | 0.75 | — | ○ |
| | | Magenta | 141.0 | 0.75 | 0.77 | — | ○ |
| | | Cyan | 140.2 | 0.73 | 0.78 | — | ○ |
| | | Black | 139.5 | 0.72 | 0.70 | — | ○ |
| Example 11 | 11 | Yellow | 143.8 | 0.75 | 0.85 | 0.64 | ○ |
| | | Magenta | 143.3 | 0.74 | 0.79 | 0.63 | ○ |
| | | Cyan | 142.0 | 0.72 | 0.76 | 0.60 | ○ |
| | | Black | 142.0 | 0.73 | 0.82 | 0.57 | ○ |
| Example 12 | 12 | Yellow | 143.8 | 0.67 | 0.83 | 0.80 | ○ |
| | | Magenta | 143.3 | 0.60 | 0.80 | 0.79 | ○ |
| | | Cyan | 142.0 | 0.65 | 0.84 | 0.75 | ○ |
| | | Black | 142.0 | 0.69 | 0.82 | 0.79 | ○ |
| Example 13 | 13 | Yellow | 143.8 | 0.73 | — | — | ○ |
| | | Magenta | 143.3 | 0.72 | — | — | ○ |
| | | Cyan | 142.0 | 0.78 | — | — | ○ |
| | | Black | 142.0 | 0.70 | — | — | ○ |
| Comparative Example 1 | 14 | Yellow | 142.3 | 0.54 | 0.56 | — | ○ |
| | | Magenta | 135.6 | 0.56 | 0.52 | — | ○ |
| | | Cyan | 137.8 | 0.53 | 0.55 | — | ○ |
| | | Black | 137.9 | 0.52 | 0.51 | — | ○ |
| Comparative | 15 | Yellow | 140.0 | 0.30 | 0.25 | — | × |
| | | Magenta | 141.0 | 0.26 | 0.23 | — | × |

TABLE 2-continued

| | oper | Devel-Color | $ML^2/A$ | $r_1$ | $r_2$ | $r_3$ | Stor-ability |
|---|---|---|---|---|---|---|---|
| Example 2 | | Cyan | 140.2 | 0.20 | 0.30 | — | × |
| | | Black | 139.5 | 0.23 | 0.26 | — | × |
| Compara- | 16 | Yellow | 140.0 | 0.33 | 0.29 | — | × |
| tive | | Magenta | 141.0 | 0.26 | 0.27 | — | × |
| Example 3 | | Cyan | 140.2 | 0.22 | 0.25 | — | × |
| | | Black | 139.5 | 0.25 | 0.24 | — | × |

From Table 1 and Table 2, it can be seen that in the toners of the examples of the invention, each correlation factor of the element originated in at least one kind of the external additive is at least 0.4 and the dispersion in the stuck amounts of the external additive among the toner particles is less. On the other hand, in the toners of Comparative Examples 1 to 3, each correlation factor of the element originated in the external additive becomes less than 0.4 and dispersion of the stuck amounts of the external additive among the toner particles is large.

Also, in the toners of Examples 1 to 13, in spite of that the toner contains the release agent, the storability is almost same as that of the toner of Comparative Example 1 without containing a release agent. In the toners of Comparative Examples 1 to 3, welding of the toner particles occur to some extent as compared with the toners of Examples 1 to 13.

[Machine evaluation]

Using the developers 1 to 16 described above, the machine evaluations of Examples 1 to 13 and Comparative Examples 1 to 3 are carried out. The results thereof are shown in Table 3 to Table 5.

In addition, the evaluation of each developer is carried out as follows.

A belt-form intermediate transfer material is mounted, a fixing apparatus is changed to PFA film coat fixing roll, using a copying machine (Acolor 635, manufactured by Fuji Xerox Co., Ltd.) modified so that the supply of a release agent can be intercepted, 30,000 copied are copied, and the charged amount, the image quality, and the transfer efficiency at the case are measured.

The transfer efficiency is evaluated as follows. That is, 0.45 g/cm$^2$ of each toner is placed on a photosensitive material and the weight of the toner transferred onto a paper is measured and the transfer efficiency is calculated from the result.

TABLE 3

| | | Beginning | | | After copying 30,000 copies | | |
|---|---|---|---|---|---|---|---|
| | | Charged amount ($\mu$Q/g) | Image quality | Transfer efficiency (%) | Charged amount ($\mu$Q/g) | Image quality | Transfer efficiency (%) |
| Example 1 | Yellow | −33.4 | No | 88.3 | −28.3 | No | 85.3 |
| | Magenta | −32.8 | problem | 87.3 | −27.9 | problem | 86.3 |
| | Cyan | −33.5 | | 88.2 | −28.6 | | 84.6 |
| | Black | −30.2 | | 88.4 | −24.3 | | 86.2 |
| Example 2 | Yellow | −35.3 | No | 86.2 | −32.3 | No | 85.1 |
| | Magenta | −34.2 | problem | 88.3 | −30.6 | problem | 86.2 |
| | Cyan | −35.3 | | 89.2 | −30.4 | | 88.2 |
| | Black | −31.4 | | 85.1 | −28.7 | | 84.3 |
| Example 3 | Yellow | −30.4 | No | 89.2 | −26.3 | No | 85.4 |
| | Magenta | −30.3 | problem | 87.2 | −25.3 | problem | 85.6 |
| | Cyan | −32.6 | | 88.3 | −26.3 | | 84.3 |
| | Black | −33.3 | | 83.5 | −25.3 | | 83.0 |
| Example 4 | Yellow | −34.6 | No | 86.1 | −28.6 | No | 83.5 |
| | Magenta | 33.5 | problem | 89.2 | −25.6 | problem | 85.6 |
| | Cyan | −33.8 | | 87.5 | −23.3 | | 85.2 |
| | Black | −30.5 | | 85.6 | −22.0 | | 84.9 |
| Example 5 | Yellow | −39.2 | No | 85.9 | −33.6 | No | 82.3 |
| | Magenta | −38.6 | problem | 86.2 | −32.1 | problem | 83.6 |
| | Cyan | −36.2 | | 87.9 | −34.6 | | 87.0 |
| | Black | −30.4 | | 88.3 | −28.6 | | 85.4 |

TABLE 4

| | | Beginning | | | After copying 30,000 copies | | |
|---|---|---|---|---|---|---|---|
| | | Charged amount ($\mu$Q/g) | Image quality | Transfer efficiency (%) | Charged amount ($\mu$Q/g) | Image quality | Transfer efficiency (%) |
| Example 6 | Yellow | −33.5 | No | 86.4 | −34.0 | No | 84.4 |
| | Magenta | −32.5 | problem | 83.6 | −31.2 | problem | 82.5 |
| | Cyan | −33.3 | | 84.9 | −30.4 | | 83.6 |
| | Black | −28.6 | | 85.6 | −25.6 | | 84.6 |
| Example 7 | Yellow | −29.9 | No | 89.2 | −23.7 | No | 87.8 |
| | Magenta | −25.6 | problem | 85.6 | −23.3 | problem | 83.6 |
| | Cyan | −30.2 | | 88.3 | −25.6 | | 85.6 |
| | Black | −24.7 | | 87.4 | −22.6 | | 84.3 |

TABLE 4-continued

| | | Beginning | | | After copying 30,000 copies | | |
|---|---|---|---|---|---|---|---|
| | | Charged amount (μQ/g) | Image quality | Transfer efficiency (%) | Charged amount (μQ/g) | Image quality | Transfer efficiency (%) |
| Example 8 | Yellow | −31.2 | No | 88.2 | −26.9 | No | 87.5 |
| | Magenta | −30.6 | problem | 85.6 | −25.3 | problem | 84.6 |
| | Cyan | −30.0 | | 87.3 | −27.8 | | 85.6 |
| | Black | −28.4 | | 89.2 | −25.6 | | 83.9 |
| Example 9 | Yellow | −34.6 | No | 88.5 | −25.6 | No | 86.0 |
| | Magenta | −33.2 | problem | 87.3 | −25.0 | problem | 85.3 |
| | Cyan | −36.2 | | 89.5 | −26.4 | | 84.3 |
| | Black | −30.4 | | 87.5 | −23.6 | | 85.6 |
| Example 10 | Yellow | −32.5 | No | 88.0 | −27.0 | No | 87.4 |
| | Magenta | −30.3 | problem | 86.7 | −24.0 | problem | 85.4 |
| | Cyan | −32.6 | | 85.9 | −28.6 | | 82.9 |
| | Black | −27.9 | | 84.6 | −24.3 | | 83.6 |

TABLE 5

| | | Beginning | | | After copying 30,000 copies | | |
|---|---|---|---|---|---|---|---|
| | | Charged amount (μQ/g) | Image quality | Transfer efficiency (%) | Charged amount (μQ/g) | Image quality | Transfer efficiency (%) |
| Example 11 | Yellow | −35.5 | No problem | 89.1 | −35.3 | No problem | 82.3 |
| | Magenta | −32.3 | | 85.6 | −31.7 | | 84.2 |
| | Cyan | −34.8 | | 87.3 | −32.5 | | 86.3 |
| | Black | −31.2 | | 89.3 | −30.6 | | 85.4 |
| Example 12 | Yellow | −36.4 | No problem | 87.9 | −30.6 | No problem | 84.5 |
| | Magenta | −35.7 | | 88.2 | −28.9 | | 84.5 |
| | Cyan | −36.9 | | 88.6 | −26.3 | | 86.9 |
| | Black | −32.0 | | 86.5 | −24.6 | | 85.4 |
| Example 13 | Yellow | −27.6 | No problem | 87.7 | −25.4 | No problem | 84.9 |
| | Magenta | −26.3 | | 86.3 | −24.3 | | 85.3 |
| | Cyan | −26.9 | | 85.5 | −23.5 | | 84.1 |
| | Black | −25.3 | | 87.3 | −22.3 | | 86.2 |
| Comparative Example 1 | Yellow | −24.4 | Fixing | 89.5 | — | — | — |
| | Magenta | −30.2 | apparatus | 88.2 | — | | — |
| | Cyan | −28.3 | clogged with | 85.6 | — | | — |
| | Black | −25.6 | paper | 84.6 | — | | — |
| Comparative Example 2 | Yellow | −33.6 | No problem | 78.3 | −19.4 | Scratches of photosensitive material, fog, | 60.3 |
| | Magenta | −31.7 | | 75.6 | −15.3 | non-imaged portion fog, density | 59.6 |
| | Cyan | −32.9 | | 76.9 | −12.3 | unevenness formed | 64.2 |
| | Black | −30.0 | | 75.8 | −10.3 | | 61.0 |
| Comparative Example 3 | Yellow | −28.9 | No problem | 75.6 | −20.4 | Scratches ot photosensitive material, fog, | 65.2 |
| | Magenta | −27.3 | | 74.6 | −18.7 | non-imaged portion fog, density | 61.2 |
| | Cyan | −28.6 | | 78.2 | −15.6 | unevenness formed | 58.9 |
| | Black | −25.6 | | 74.9 | −12.3 | | 54.3 |

As the results thereof, it can be seen that the toners of Examples 1 to 13 show, in spite of that each toner contains a release agent, a high transfer efficiency of the same level as the toner of Comparative Example 1 without containing a release agent. Also, in the toners of the examples, even when 30,000 copied are copied, both the charging property and the image quality are good in each case. On the other hand, in the toner of Comparative Example, a transfer paper is wound round a fixing roll from the beginning to cause a trouble of paper clogging and the test cannot be continued. In the toners of Comparative Examples 2 and 3, lowering of the charged amount occurs and the toner is transferred to a background portions. Also, in these toners, the transfer efficiency is lowered. Furthermore, in these toners, the photoreceptor is scratched by the liberated external additive. Also, the toner is transferred in the state of being aggregated to cause a phenomenon of forming unfilled spots around the aggregates and the portions have a color different from the color of the original, the regeneration in hue is inferior, and as a whole, the images formed have the image quality which cannot faithfully regenerate the original. In this case, when each toner of the comparative examples in a toner supplying cartridge is sieved by a sieve of 108 μm, it is confirmed that many aggregates of the toner exist.

As described above in detail, the electrostatic latent image developing toners of this invention are excellent in the fluidity, the charging property, the developing property, and the transferring property, can simultaneously satisfy the characteristics of preventing the formation of fog on photosensitive material and preventing staining the inside of a copying machine for a long period of time, and provide good full color images for a long period of time.

Also, the image forming process of the invention gives the effect of obtaining images having a high quality for a long period of time even by applying oil-less fixing because of using the above-described toner of the invention.

What is claimed is:

1. A full-color electrostatic latent image developing toner comprising a toner particles containing a binder resin, a colorant, and a release agent, and at least one kind of an external additive, wherein the amount of the release agent is at least about 3%, the toner particles having irregular-shaped toner of $ML^2/A \geqq 125$, and when an emission voltage caused by the carbon originated in the binder resin of the toner particles is X and an emission voltage caused by the element originated in the external additive is Y, and when the relationship of $X^{(2/3)}$ and Y are primary-regressed to an straight line passing through origin of a coordinate, the correlation factor of the element originated in at least one kind of the external additive is not less than 0.4.

2. The full-color electrostatic latent image developing toner according to claim 1 wherein the full-color toner including a cyan toner, a magenta toner and a yellow toner and these color toners having the difference in the correlation factors based on the same external additive is within about 0.1.

3. The full-color electrostatic latent image developing toner according to claim 1 wherein the toner having at least two kinds of external additives which having a different particle size.

4. The full-color electrostatic latent image developing toner according to claim 1 wherein the external additive is selected from the group consisting of silica, a titanium oxide compound, alumina, cerium oxide, strontium titanate, calcium carbonate, calcium phosphate, fluorine-containing resin fine particles, silicon-containing resin fine particles, and nitrogen-containing resin fine particles.

5. The full-color electrostatic latent image developing toner according to claim 1 wherein the binder resin is polyester resin.

6. The full-color electrostatic latent image developing toner according to claim 1 wherein the release agent is a wax having a melting point in the range of from about 80 to 120° C. and a melt viscosity in the range of from about 1 to 200 centipoise.

7. The full-color electrostatic latent image developing toner according to claim 4 wherein the external additive is selected from the group consisting of silica and a titanium oxide compound.

8. The full-color electrostatic latent image developing toner according to claim 7 wherein the titanium oxide compound is prepared by a wet method.

9. The full-color electrostatic latent image developing toner according to claim 7 wherein when silica is used as the external additive, the correlation factor originated in silica is at least about 0.6.

10. The full-color electrostatic latent image developing toner according to claim 1 wherein the binder resin has a softening point of from about 90 to 150° C., a number average molecular weight of from about 2000 to 6000, and a weight average molecular weight of from about 8000 to 150,000.

11. The full-color electrostatic latent image developing toner according to claim 1 wherein the binder resin has an acid value of from about 5 to 40 and a hydroxyl value of from about 5 to 40.

12. The full-color electrostatic latent image developing toner according to claim 1 wherein the amount of the release agent is not more than about 30% by weight.

13. The full-color electrostatic latent image developing toner according to claim 1 wherein the BET specific area of the external additive is from 20 to 250 $m^2/g$.

14. A two-component developer comprising a carrier and the full-color electrostatic latent image developing toner as claimed in claim 1.

15. An image-forming process comprising an latent image-forming step of forming a electrostatic latent image on a electrostatic latent image holding member, a developing step of forming a toner image by developing the latent image with a toner, a transferring step of transferring the toner image obtained onto a transfer material, and a fixing step of fixing the transferred toner image without substantially using an oil, wherein in the developing step, the full-color electrostatic latent image developing toner described in claim 1 is used.

* * * * *